US006520833B1

(12) United States Patent
Saldana et al.

(10) Patent No.: US 6,520,833 B1
(45) Date of Patent: Feb. 18, 2003

(54) OSCILLATING FIXED ABRASIVE CMP SYSTEM AND METHODS FOR IMPLEMENTING THE SAME

(75) Inventors: Miguel A. Saldana, Fremont; Aleksander A. Owczarz, San Jose, both of CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/608,513

(22) Filed: Jun. 30, 2000

(51) Int. Cl.[7] ..... B24B 49/00

(52) U.S. Cl. ..... 451/5; 451/8; 451/167; 451/173

(58) Field of Search ..... 451/5, 8, 167, 451/173

(56) References Cited

U.S. PATENT DOCUMENTS

| | | | | | |
|---|---|---|---|---|---|
| 3,971,163 | A | * | 7/1976 | Trombley et al. | 451/163 |
| 5,335,453 | A | | 8/1994 | Baldy et al. | 51/67 |
| 5,573,444 | A | * | 11/1996 | Ryoke et al. | 451/28 |
| 5,586,926 | A | * | 12/1996 | Wedell et al. | 451/299 |
| 5,645,471 | A | * | 7/1997 | Strecker | 451/299 |
| 5,695,386 | A | * | 12/1997 | Ryoke et al. | 451/296 |
| 5,733,178 | A | * | 3/1998 | Ohishi | 451/41 |
| 5,919,082 | A | | 7/1999 | Walker et al. | 451/41 |
| 6,039,633 | A | | 3/2000 | Chopra | 451/41 |
| 6,069,080 | A | | 5/2000 | James et al. | 438/691 |
| 6,103,628 | A | | 8/2000 | Talieh | 438/692 |
| 6,135,859 | A | | 10/2000 | Tietz | 451/41 |
| 6,139,402 | A | * | 10/2000 | Moore | 451/168 |
| 6,261,163 | B1 | | 7/2001 | Walker et al. | 451/311 |
| 6,277,005 | B1 | * | 8/2001 | Reynen et al. | 451/168 |

FOREIGN PATENT DOCUMENTS

| | | | |
|---|---|---|---|
| WO | WO 98/45090 | 10/1998 | B24B/53/10 |
| WO | WO 00/32356 | 8/2000 | B24B/37/04 |

* cited by examiner

*Primary Examiner*—M. Rachuba
(74) *Attorney, Agent, or Firm*—Martine & Penilla, LLP

(57) ABSTRACT

A chemical mechanical polishing (CMP) apparatus is provided. A first roller is situated at a first point and a second roller situated at a second point, such that the first point is separate from the second point. A polishing pad strip is also included and has a first end secured to the first roller and a second end secured to the second roller in a web handling arrangement. The polishing pad strip is configured to provide a surface onto which a substrate to be polished is lowered. Preferably, the polishing pad strip is a fixed abrasive pad and is configured to receive chemicals or DI water so as to facilitate a removal of material from a surface of the substrate.

22 Claims, 7 Drawing Sheets

OSCILLATING FIXED ABRASIVE CMP SYSTEM AND METHODS FOR IMPLEMENTING THE SAME

BACKGROUND OF THE INVENTION

1. Field of the Invention

The present invention relates generally to chemical mechanical polishing (CMP) systems and techniques for improving the performance and effectiveness of CMP operations. Specifically, the present invention relates to CMP systems that use a fixed abrasive polishing pad arranged in a web handling system.

2. Description of the Related Art

In the fabrication of semiconductor devices, there is a need to perform CMP operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization.

In the prior art, CMP systems typically implement belt, orbital, or brush stations in which belts, pads, or brushes are used to scrub, buff, and polish one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1 illustrates an exemplary prior art CMP system 100. The CMP system 100 in FIG. 1 is a belt-type system, so designated because the preparation surface is an endless belt 108 mounted on two drums 114 which drive the belt 108 in a rotational motion as indicated by belt rotation directional arrows 116. A wafer 102 is mounted on a carrier 104. The carrier 104 is rotated in direction 106. The rotating wafer 102 is then applied against the rotating belt 108 with a force F to accomplish a CMP process. Some CMP processes require significant force F to be applied. A platen 112 is provided to stabilize the belt 108 and to provide a solid surface onto which to apply the wafer 102. Slurry 118 composing of an aqueous solution such as $NH_4OH$ or DI water containing dispersed abrasive particles is introduced upstream of the wafer 102. The process of scrubbing, buffing and polishing of the surface of the wafer is achieved by using an endless polishing pad glued to the belt 108. Typically, the polishing pad is composed of porous or fibrous materials and lacks fixed abrasive particles.

After the polishing pad polishes a limited number of wafers, the surface of the pad is conditioned and cleaned in order to remove the attached abrasive materials of the slurry and the particles removed from the wafer. Subsequent to cleaning and conditioning, the polishing pad will have a significant amount of particles that remain attached to the surface of the polishing pad causing the polishing pad to lose its effectiveness. The polishing pad also loses its effectiveness due to normal wear of the material itself. As a result, the polishing pad must be replaced in its entirety. The removal of the used polishing pad and its subsequent replacement with a new polishing pad is very time consuming and labor intensive. Additionally, the time needed to perform the replacement necessarily requires that the polishing system be taken off-line, which thus reduces throughput.

In view of the foregoing, a need therefore exists in the art for a chemical mechanical polishing system that will enable polishing surface layers of a wafer using a polishing pad that is less expensive to maintain and is more effectively serviced after its use degrades the effectiveness of the polishing.

SUMMARY OF THE INVENTION

Broadly speaking, the present invention fills these needs by providing an apparatus and related methods for efficiently polishing layer surfaces of a semiconductor wafer. Preferably, the CMP system is designed to implement a polishing pad strip that is less expensive to maintain and is more efficiently serviced after it loses its effectiveness to polish. In preferred embodiments, the polishing pad is a fixed abrasive polishing pad strip that is connected between a feed roll and a take-up. It should be appreciated that the present invention can be implemented in numerous ways, including as a process, an apparatus, a system, a device, or a method. Several inventive embodiments of the present invention are described below.

In one embodiment, a chemical mechanical polishing (CMP) apparatus is disclosed. The CMP apparatus includes a polishing pad strip defined between a first point and a second point. The first point is separate from the second point. Also included is a feed roll having a supply of the polishing pad strip, and the feed roll is configured to define a location of the first point. A take-up roll is further included and it is configured to collect at least a linear portion of the polishing pad strip.

In another embodiment, a chemical mechanical polishing (CMP) apparatus is disclosed. A first roller is situated at a first point and a second roller situated at a second point, such that the first point is separate from the second point. A polishing pad strip is also included and has a first end secured to the first roller and a second end secured to the second roller. The polishing pad strip is configured to provide a surface onto which a substrate to be polished is lowered. Preferably, the polishing pad strip is a fixed abrasive pad and is configured to receive chemicals or DI water so as to facilitate a removal of material from a surface of the substrate.

In still a further embodiment, a method for polishing a semiconductor wafer is disclosed. The method includes providing a polishing pad strip that is to be connected between a first point and a second point. The method then includes applying a tension to the polishing pad strip. Once the desired tension is applied, the polishing pad strip is oscillated between the first point and the second point. The semiconductor wafer is then applied to the oscillating polishing pad strip to commence the CMP process. The method can further include applying a chemical solution to the polishing pad strip before the applying of the semiconductor wafer. Furthermore, the method can include monitoring a linear velocity of the oscillating polishing pad strip, and controlling a setting of the linear velocity of the oscillating polishing pad strip. In addition, the method can include monitoring a tension of the polishing pad strip, and controlling a setting of the tension of the oscillating polishing pad strip.

The advantages of the present invention are numerous. Most notably, instead of a continuous belt polishing pad, a supply of polishing pad strip is provided between a feed roll and a take-up roll in a web handling arrangement. Thus, replacing used portions of the polishing pad strip with fresh portions of the polishing pad strip can be accomplished utilizing minimal effort and in significantly less amount of time. Furthermore, the re-supplying of the polishing pad strip can be achieved easily and expeditiously thereby minimizing the length of time needed to take the polishing system off-line thus having minimal effect on the throughput. Accordingly, the apparatus and the methods of the present invention provide for polishing surface layers of a wafer using a polishing pad that is less expensive to maintain and is more effectively serviced after its use degrades the effectiveness of the polishing.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

FIG. 2D-1 is a plan-view of an abrasive polishing pad strip, in accordance with yet another embodiment of the present invention.

FIG. 2D-2 is a cross-sectional view of an abrasive polishing pad strip, revealing the plurality of posts containing a plurality of abrasive particles, in accordance with yet another embodiment of the present invention.

DETAILED DESCRIPTION OF THE PREFERRED EMBODIMENTS

An invention for a CMP system, which enables efficient polishing of layer surfaces of a wafer is described. The CMP system preferably implements a polishing pad that is less expensive to maintain and is more efficiently serviced after it loses its effectiveness to polish. In preferred embodiments, the polishing pad is a fixed abrasive polishing pad. The fixed abrasive polishing pad is preferably provided as a polishing pad strip that is connected between a feed roll and a take-up. This configuration is referred to herein as a web handling arrangement. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 2A:
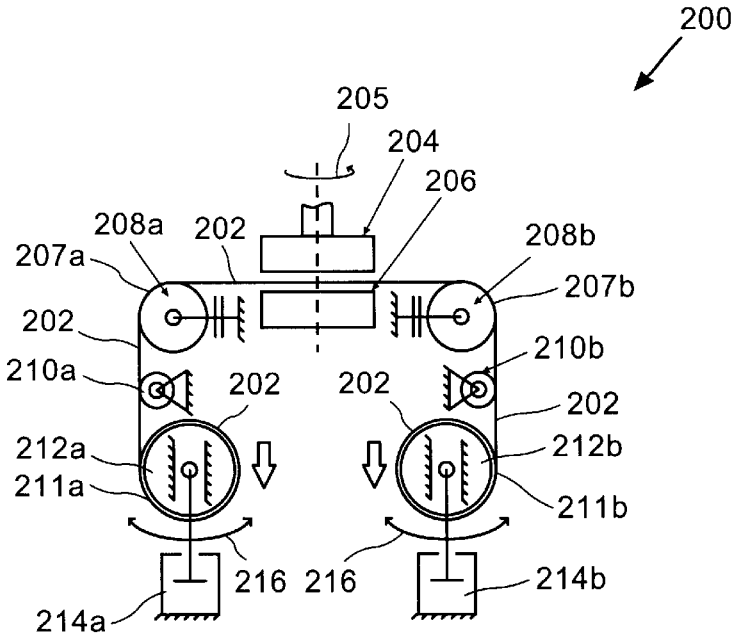
FIG. 2A is a cross-sectional view of an oscillating CMP system, in accordance with one embodiment of the present invention.

FIG. 2A is a cross-sectional view of an oscillating CMP system 200, in accordance with one embodiment of the present invention. The CMP system 200 in FIG. 2A includes a feed roll 212*a* positioned at a first point 211*a*. The feed roll 212*a* is configured to hold a roll of a polishing pad strip 202. A take-up roll 212*b* is positioned at a second point 211*b*, and is placed, in this embodiment, symmetrically across from the feed roll 212*a* and is configured to receive the polishing pad strip 202. The direct distance between the feed roll 212*a* and take-up roll 212*b* is estimated to be about 20 inches. Of course, the distance between the feed roll 212*a* and take-up roll 212*b* may vary depending on the specific implementation. In this embodiment, each of the feed roll 212*a* and the take-up roll 212*b* is designed to contain an internal motor. Preferably, the internal motor is a servo drive, such as a direct drive servo. The internal motors are designed to allow the feed roll 212*a* and take-up roll 212*b* to reciprocate. The reciprocating motions of the feed roll 212*a* and take-up roll 212*b* cause the polishing pad strip to oscillate at a linear velocity ranging from about 140 feet per second to about 350 feet per second. The actual linear velocity selected for a polishing operation will also depend on the force at which a polishing head holding a wafer is applied to the polishing pad strip and the platen. The limits of the linear velocity and the force are generally calibrated using the well known Preston's Equation. According to Preston's Equation, Removal Rate=KpPV, where the removal rate of material is a function of Downforce (P) and Linear Velocity (V), with Kp being the Preston Coefficient, a constant determined by the chemical composition of the slurry (or fixed abrasive material and chemicals), the process temperature, and the pad surface, among other variables.

In this embodiment, tension actuators 214*a* and 214*b* are positioned directly below the feed roll 212*a* and take-up roll 212*b*, respectively. The tension actuators 214*a* and 214*b* are configured to controllably pull on the feed roll 212*a* and take-up roll 212*b* thereby causing the feed roll 212*a* and take-up roll 212*b* to exert tension on the polishing pad strip 202. It should be understood that each of the tension actuators can be any type of linear actuator. For instance, each tension actuator can be replaced with cylinders, coils, screws or linear motors.

Positioned above the feed roll 212*a* is a load cell roller 208*a* defined by a roller that measures the tension exerted on the polishing pad strip 202 on the side closest to intermediate point 207*a* (e.g., left side). The load cell roller 208*b* is also defined by a roller that measures the tension exerted on the polishing pad strip 202 on the side closest to the intermediate point 207*b* (e.g., right side). In this example, the load cell roller 208*b* is positioned symmetrically across from the load cell roller 208*a* and directly above the take-up roll 211*b*. Therefore, the polishing pad strip 202 is located on top of the load cell rollers 208*a* and 208*b*, and the load cell rollers 208*a* and 208*b* are configured to provide a location where the polishing pad strip 202 is caused to change angular orientation. For instance, the angular orientation may be about 90 degrees so that only the horizontal components of the forces applied on the load cell rollers 208*a* and 208*b* are measured. An idler roller 210*a* defined by a roller fixed to a point is positioned between feed roll 212*a* and load cell roller 208*a*. Across from the idler roller 210*a*, is positioned an idler roller 210*b*. The idler rollers 210*a* and 210*b* are designed to support the polishing pad strip along a path that will ensure the 90-degree angle described above. Thus, the idler rollers 210*a* and 210*b* are further designed to allow the load cell rollers 208*a* and 208*b* to measure only the horizontal components of the forces applied on the load cell rollers 208*a* and 208*b*. The horizontal components of the applied forces are equivalent to the tension exerted on the polishing pad strip 202 on the left side and the right side of the polishing head 204.

A polishing head 204 is designed to carry a wafer (not shown in the figure) and rotates in a rotation direction 205. A platen 206 is positioned horizontally between load cell rollers 208*a* and 208*b*. Platen 206 is configured to stabilize the polishing pad strip 202 and to provide a solid surface onto which to apply the polishing head 204. In some cases, it is possible to control the surface between the platen 206 and the polishing pad strip 202 to control the removal rate in different locations on the wafer. In one embodiment, the polishing pad strip 202 is a fixed abrasive polishing pad which has a polishing layer containing abrasive particles extended throughout the surface and the material thickness. As the polishing head 204 applies the wafer (not shown in the figure) against the polishing pad strip 202, the abrasive particles of the polishing pad strip 202 become loose thereby eliminating the necessity to use a slurry containing abrasive materials. Although a slurry containing abrasive particles is not required, a liquid solution (e.g., $NH_4OH$ or DI water) is preferably used to facilitate the polishing process.

Figure 2B:
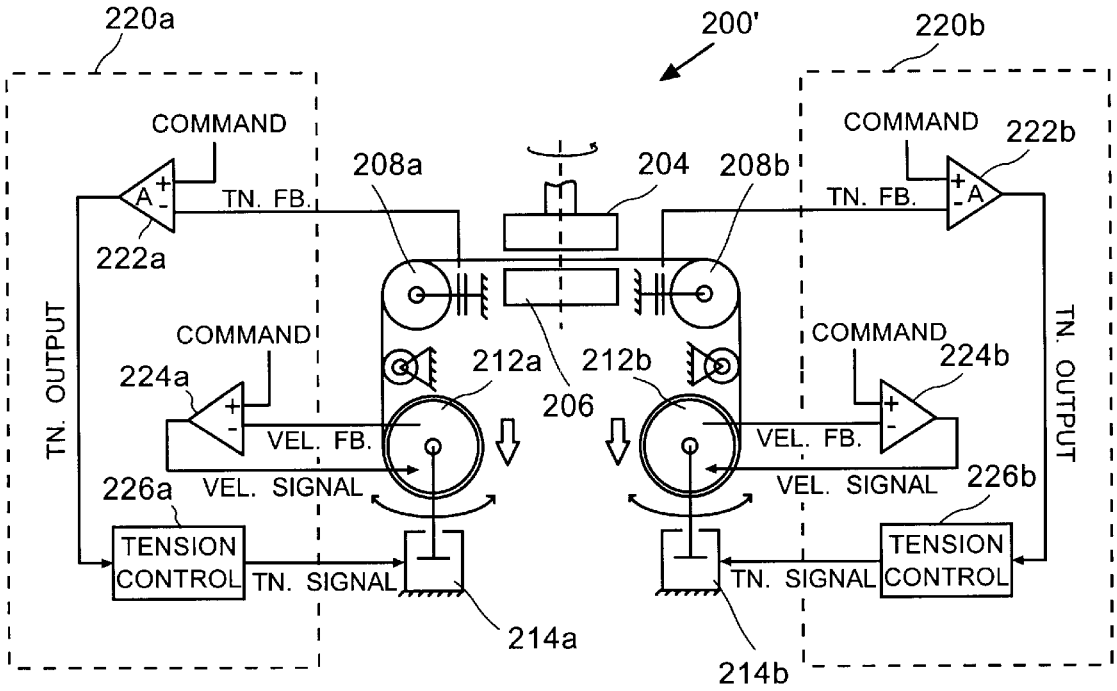
FIG. 2B is a cross-sectional view of an oscillating CMP system, illustrating the system's tension setting mechanism and velocity control mechanism, in accordance with another embodiment of the present invention.

As depicted in the embodiment of FIG. 2B, a certain portion of the supplied polishing pad strip 202 held in the feed roll 212*a* is fed around the load cell rollers 208*a* and 208*b* to the take-up roll 211*b*. After polishing a given number of wafers, the portion of the polishing pad strip 202 which came into contact with the wafers loses its effectiveness and must be replaced. The used portion of the polishing pad strip 202 is replaced by an unused portion of the polishing pad strip 202 by way of the feed roll 212*a* indexing the polishing pad strip 202, utilizing a programmable amount (e.g., enough to place a fresh portion of the polishing pad strip 202 over the platen 206). The indexing causes the used portions of the polishing pad strip 202 to be pushed farther and farther away from the polishing area. The used portions of the polishing pad strip 202 are collected by the take-up roll 212*b* and will ultimately be discarded. Once the supply of the polishing pad strip 202 held in feed roll 212*a* is completely consumed, it can easily be replaced with a new roll of the polishing pad strip 202. The process of re-supplying the feed roll 212*a* with the polishing pad strip 202 is neither labor intensive nor time consuming. More importantly, the CMP machine will be off-line, if necessary, less frequently and for a significantly less amount of time thereby causing minimal effect on the throughput of the machine.

Also clearly shown in FIG. 2B are the tension actuators 214*a* and 214*b* which are configured to controllably pull on the feed roll 212*a* and take-up roll 212*b* causing the feed roll 212*a* and take-up roll 212*b* to apply pressure to the polishing pad strip 202 at the first intermediate point 207a and the second intermediate point 207*b*, respectively. Due to normal wear, the polishing pad strip 202 can stretch, thereby causing the amount of tension exerted on the polishing pad strip 202 to reduce. This system is designed to maintain a desired tension by way of changing the amount of force the tension actuators 214*a* and 214*b* apply on the feed roll 212*a* and take-up roll 212*b*, respectively.

This task is achieved by the load cell roller 208*a* sending a tension feedback signal to an amplifier 222*a*, which is a part of a first tension-velocity controller 220*a*. Subsequently, a tension setting command, either supplied manually or automatically through a computerized device, is fed to the amplifier 222*a*. Thereafter, the amplifier 222*a* sends a tension output signal to a tension control device 226*a*, which is also a part of the tension-velocity controller 220*a*. Finally, the tension control device 226*a* sends a tension (TN) signal to the tension actuator 214*a*.

In a like manner, an amplifier 222*b*, which is a part of a tension-velocity controller 220*b* receives a tension feedback (FB) signal from load cell roller 208*b*. Subsequently, a tension setting command, either supplied manually or automatically through a computerized device, is fed to the amplifier 222*b*. Thereafter, the amplifier 222*b* sends a tension (TN) output signal to a tension control device 226*b*, which is also a part of the tension-velocity controller 220*b*. Finally, the tension control device 226*b* sends a tension signal to the tension actuator 214*a*. Depending on the tension signals received from the tension-velocity controllers 220*a* and 220*b*, the tension actuators 214*a* and 214*b* may or may not exert additional force on the feed roll 212*a* and take-up roll 212*b* so as to achieve a desired tension (e.g., either higher or lower).

Once the desired tension is exerted on the polishing pad strip 202, the internal motors located inside the feed roll 212*a* and take-up roll 212*b* will cause the feed roll 212*a* and take-up roll 212*b* to reciprocate, synchronously, thereby causing the polishing pad strip 202, to oscillate at a linear velocity. In one embodiment, to achieve optimum performance, the linear velocity of the polishing pad strip 202 should be maintained within the range of about 140 ft/sec and about 350 ft/sec. Thus, the linear velocity of the polishing pad strip 202 should be measured frequently by the feed roll 212*a* and take-up roll 212*b*. Besides measuring the velocity of the polishing pad strip 202, the feed roll 212*a* and take-up roll 212*b* control and change, if necessary, the velocity of the polishing pad 202 so as to maintain a desired velocity.

As an example, the feed roll 212*a* initially sends out a velocity feedback to a Proportional, Integral and Derivative (PID) 224*a*, which is a part of the tension-velocity controller 220*a*. Then, a velocity setting command, either supplied manually or automatically using a computerized device, is fed to the PID 224*a*. Finally, the PID 224*a* sends out a velocity signal to the feed roll 212*a*.

Similarly, the take-up roll 212*b* sends out a velocity feedback to a Proportional, Integral and Derivative (PID) 224*b*, which is a part of the tension-velocity controller 220*b*. Then, a velocity setting command, either supplied manually or by way of a programmable machine, is fed to the PID 224*b*. Finally, the PID 224*b* sends out a velocity signal to the take-up roll 212*b*. The velocity signals received by the feed roll 212*a* and the take-up roll 212*b* are the determinative factors as to whether the feed roll 212*a* and take-up roll 212*b* must maintain or change the rate of reciprocating. Although the tension-velocity controllers 220*a* and 220*b* have been illustrated using exemplary electronics, it should be understood that the electronics and control signals can be processed using any other suitable well known processing techniques (e.g., software/hardware combinations). For instance, the PID electronics can be substituted with other circuitry that can process and control the signals as may be desired.

Figure 2C:
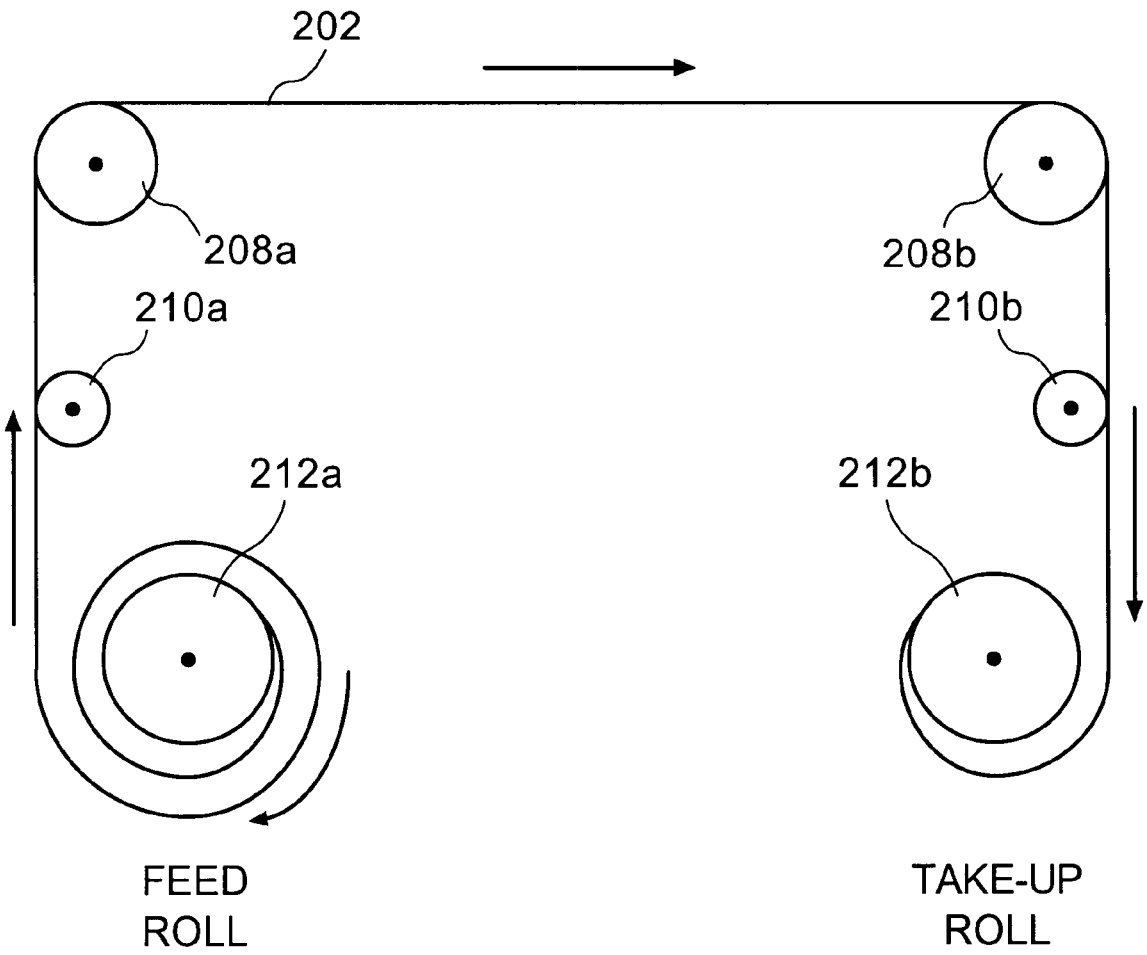
FIG. 2C is a cross-sectional view of an oscillating CMP system, illustrating the feed roll's design to hold an ample supply of the polishing pad strip, in accordance with yet another embodiment of the present invention.

As clearly evident from the embodiment of FIG. 2C, the feed roll 212*a* is designed to hold an ample supply of the polishing pad strip 202. Utilizing minimal effort, the feed roll 212*a* can be re-supplied with the fresh polishing pad strip 202 thereby having minimum effect on the throughput of the CMP machine.

Figure 1:
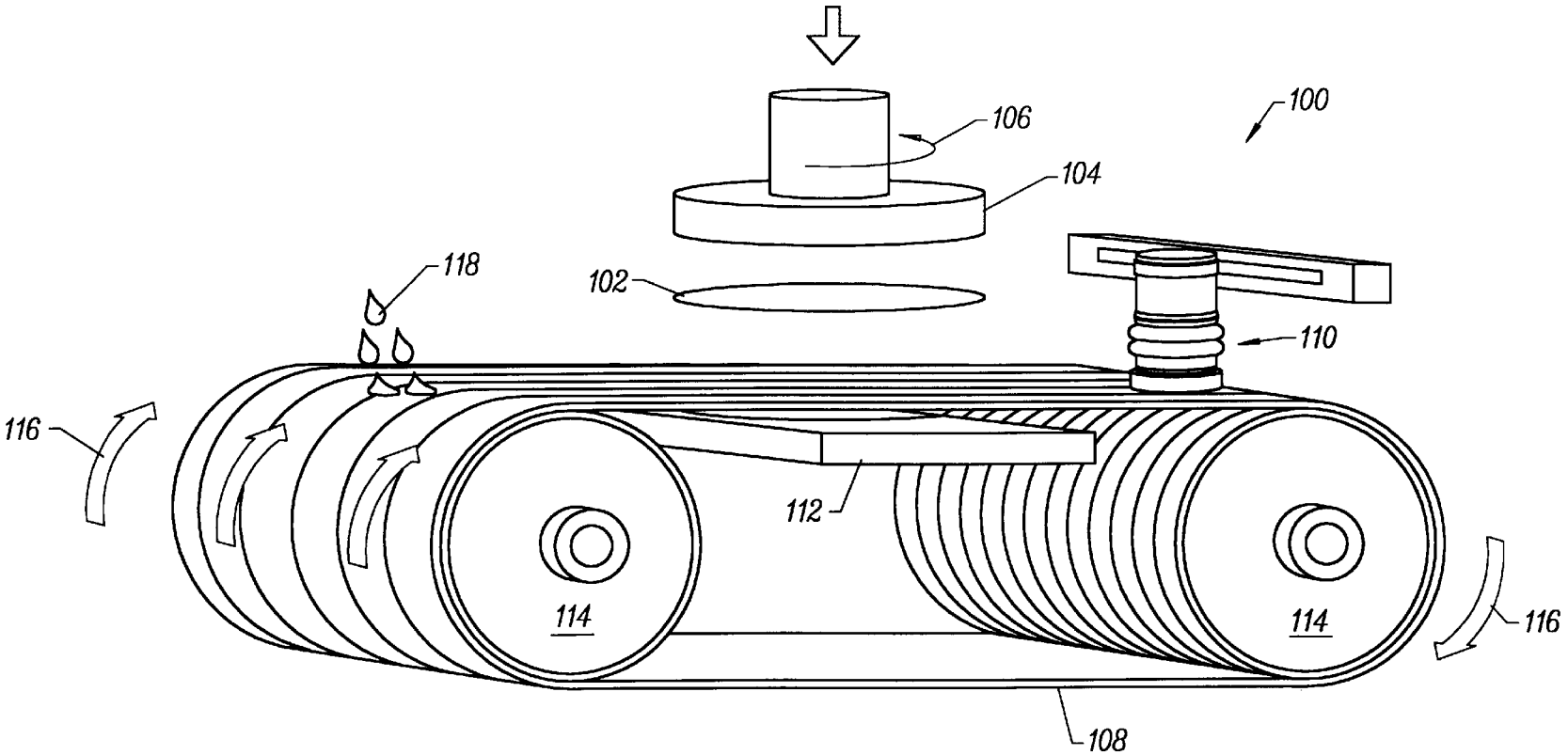
FIG. 1 (Prior Art)
FIG. 1 illustrates an exemplary prior art CMP system.
Figures 1, 2D:
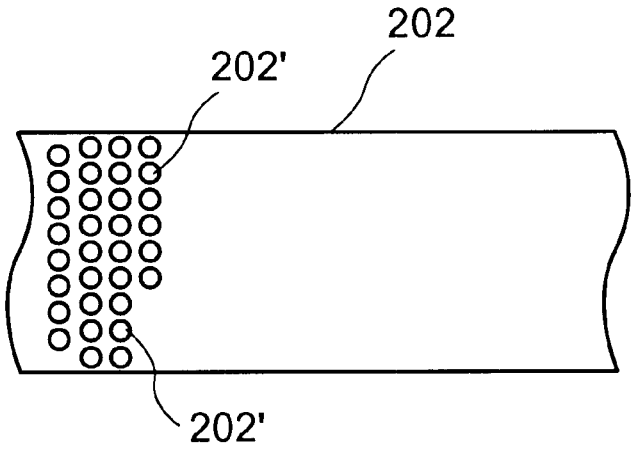
Figures 2, 2D:
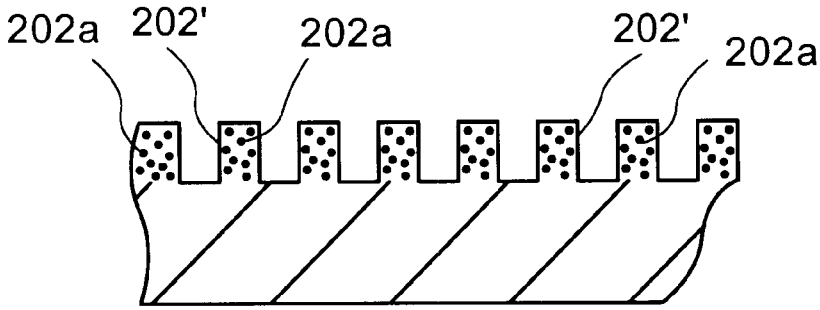

FIG. 2D-1 depicts one of many types of the polishing pad strip 202, which has a fixed abrasive polishing layer. The approximate thickness of this type of polishing pad strip 202 ranges from about 0.004 inch to about 0.010 inch. Embedded and extended through out the surface of this type of polishing pad strip 202 are several three-dimensional protrusions, which are defined as posts 202'. The cross-sectional view of the polishing pad strip 202, as shown in FIG. 2D-2, reveals that each post 202' contains a plurality of abrasive particles having an approximate size in the range from about 40 micrometer and about 200 micrometer.

Figure 3A:
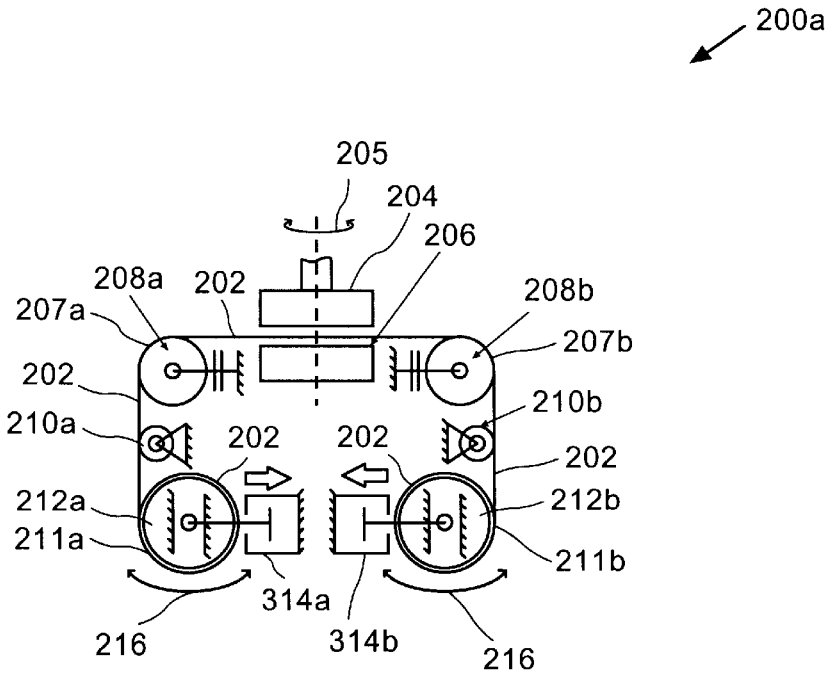
FIG. 3A is a cross-sectional view of the CMP system in which the tension actuators are positioned to the right and to the left of the feed roll and the take-up roll, respectively, in accordance with yet another embodiment of the present invention.

Another embodiment of the present invention is shown in FIG. 3A wherein the tension actuator 314*a* is positioned to the right of the feed roll 212*a*. In a like manner, the tension actuator 314*b* is situated to the left of the take-up roll 212*b*. In this embodiment, by respectively pulling on the feed roll 212*a* and take-up roll 212*b*, the tension actuators 314*a* and 314*b* will cause the feed roll 212*a* and take-up roll 212*b* to controllably exert tension on the polishing pad strip 202.

Figure 3B:
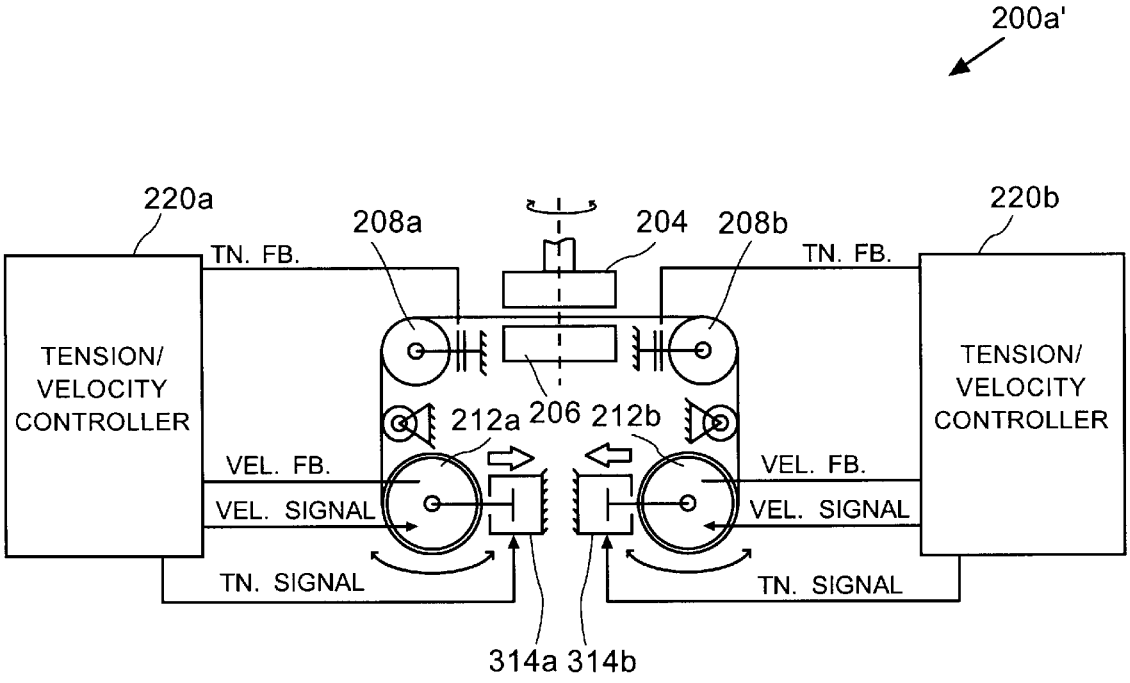
FIG. 3B is a cross-sectional view of the CMP system, depicting the system's tension setting and velocity control mechanisms, in accordance with yet another embodiment of the invention.

For example, in the embodiment of FIG. 3B, the tension actuators 314*a* and 314*b* control the amount of tension exerted on the polishing pad strip 202. This is achieved by the load cell roller 208*a* sending out a tension feedback to the tension/velocity controller 220*a*, which in turn, after internally processing the tension feedback, sends a tension signal to the tension actuator 314*a*. Similarly, the load cell roller 208*b* sends out a tension feedback to the tension/velocity controller 220*b*. Once the tension/velocity controller 220*b* processes the tension feedback, internally, it sends a tension signal to the tension actuator 314*b*. Depending on the tension signals received, if necessary, the tension actuators 314*a* and 314*b*, may change the amount of force each of them exerts on the feed roll 212*a* and take-up roll 212*b* so as to achieve a desired tension.

Once the desired tension is set for the polishing pad strip 202, the synchronous reciprocation of the feed roll 212*a* and take-up roll 212*b* start thereby causing the polishing pad strip 202 to oscillate at a linear velocity. In one embodiment, the linear velocity of the polishing pad strip 202 may be measured frequently or at set times. Depending upon the measurements, adjustments can be made to the tension that is controlled by the feed roll 212*a* and take-up roll 212*b*. The feed roll 212*a* and take-up roll 212*b* each send out a velocity feedback to the tension/velocity controllers 220*a* and 220*b*, respectively. Then, after internally processing the velocity feedbacks, the tension/velocity controllers 220*a* and 220*b*, each sends out a velocity signal to the feed roll 212*a* and take-up roll 212*b*. Depending on the velocity signals received, if necessary, the feed roll 212*a* and take-up roll 212*b* may change the rate of reciprocating, thus fixing a new linear velocity for the polishing pad strip 202.

Figure 4A:
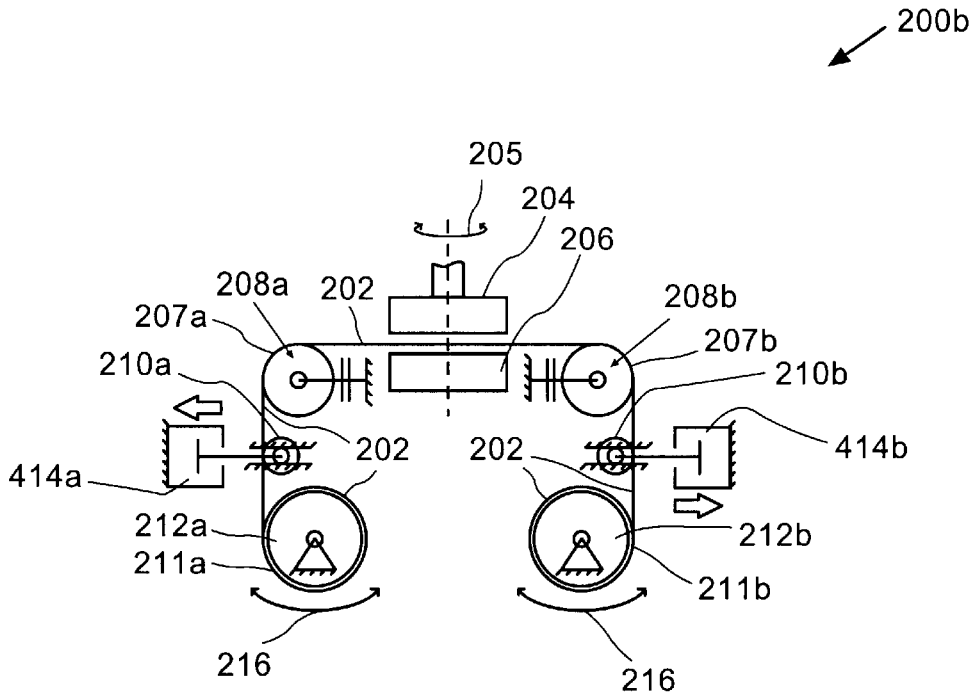
FIG. 4A is a cross-sectional view of the CUT system in which the tension actuators are connected to the idler rollers, in accordance with yet another embodiment of the present invention.

The embodiment of FIG. 4A depicts an oscillating CMP system 200*b* that is similar to the embodiment of FIG. 2A, with the exception that the tension actuators 414*a* and 414*b* are positioned outside the idler rollers 210*a* and 210*b*. In this embodiment, the tension actuators are configured to pull on the idler rollers 210*a* and 210*b* so as to cause the idler rollers 210*a* and 210*b* to exert tension on the polishing pad strip 202.

In this case, there will be points in time when the vertical portions of the polishing pad strip 202 will not be at a 90 degree angle relative to the polishing region (e.g., where the platen 206 is located) of the polishing pad strip 202. Nevertheless, the tension can be controllably adjusted to a correct desired level. It should therefore be understood that it is not necessary to have the vertical and horizontal portions of the polishing pad strip 202 at a 90 degree angle at all times so long as the polishing pad strip 202 provides the desired optimum polishing condition at the location where polishing is to be performed on the wafer surfaces.

Figure 4B:
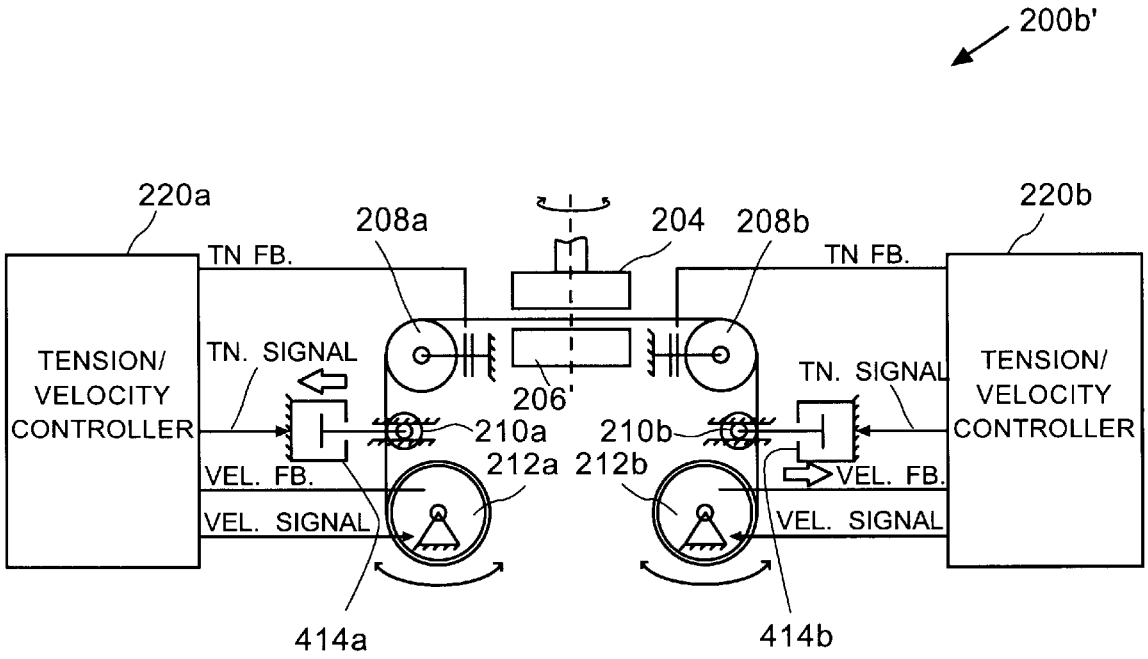
FIG. 4B is a cross-sectional view of the CMP system, depicting the system's tension setting mechanism as well as velocity control mechanism, in accordance with yet another embodiment of the invention.

As shown in the embodiment of FIG. 4B, the load cell roller 208*a* sends out a tension feedback to the tension/velocity controller 220*a*. After internally processing the tension feedback, the tension/velocity controller 220*a* sends out a tension signal to the tension actuator 414*a*. Similar signals are also exchanged between the load cell roller 208*b*, tension/velocity controller 220*b* and tension actuator 414*b*.

Once each of the tension actuators 414*a* and 414*b* respectively receive a tension signal from 220*a* and 220*b*, depending on the tension signals received, tension actuators may, if necessary, change the force by which they exert tension on the polishing pad strip 202. After achieving the desired tension, the feed roll 212*a* and take-up roll 212*b* start reciprocating, preferably synchronously, causing the polishing pad strip to oscillate at a desired linear velocity. Similar to the embodiments of FIGS. 2B and 3B, the feed roll 212*a* and take-up roll 212*b* maintain and if necessary, change the velocity of the oscillation of the polishing pad strip 202.

Figure 5A:
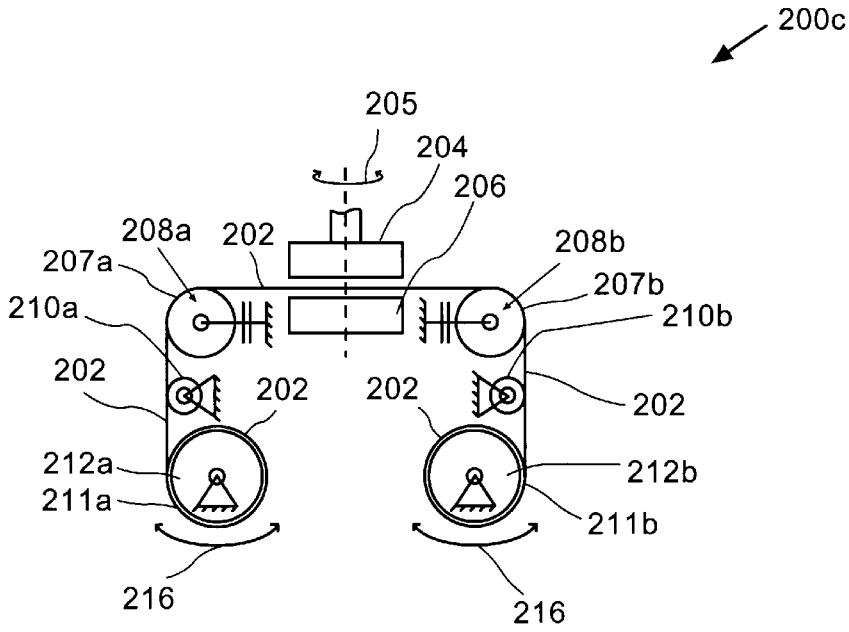
FIG. 5A is a cross-sectional view of the CMP system in which the feed roll and take-up roll maintain and control both the tension exerted on the polishing pad strip as well as the linear velocity of the polishing pad strip, in accordance with yet another embodiment of the invention.

FIG. 5A depicts an oscillating CMP system 200*c* wherein the feed roll 212*a* and take-up roll 212*b* maintain and control both the tension exerted on the polishing pad strip 202 as well as the linear velocity of the polishing pad 202. Accordingly, the tension actuators have completely been eliminated from the CMP system 200*c*.

Figure 5B:
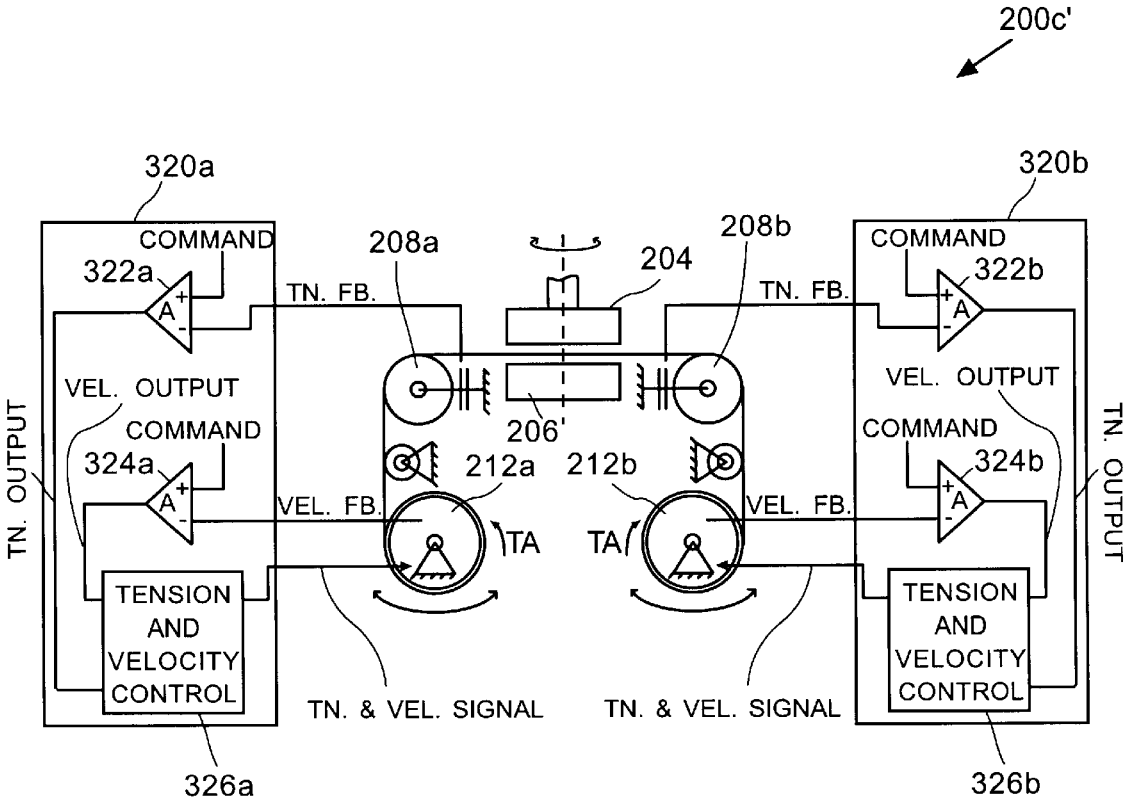
FIG. 5B is a cross-sectional view of the CMP system, depicting the system's tension and velocity control mechanism, in accordance with yet another embodiment of the invention.

As illustrated in FIG. 5B, in a CMP system 200*c*', the load cell roller 208*a* sends a tension feedback to an amplifier 322*a* that is part of the tension-and-velocity controller 320*a*. Thereafter, a tension setting command, supplied either manually or automatically through a computerized device, is fed to the amplifier 322*a*. Then, the amplifier 322*a* sends a tension output signal to a tension and velocity control device 326*a*.

Thereafter, a velocity feedback is sent from feed roll 212*a* to a PID 324*a* also positioned within the tension-and-velocity controller 320*a*. In a subsequent operation, a velocity setting command, supplied either manually or by way of a programmable machine, is fed to the PID 324*a*. Then, the PID 324*a* sends a velocity output signal to the tension and velocity control 326*a*. After receiving the tension output signal and the velocity output signal, the tension and velocity control 326*a* sends out a tension and velocity signal to the feed roll 212*a*.

Similarly, a tension feedback and a velocity feedback are respectively fed to an amplifier 322*b* and a PID 324*b*, which are part of the tension-and-velocity controller 320*b*. Then, a tension setting command is fed to the amplifier 322*b*, which in turn, sends out a tension output signal to a tension and velocity control 326*b*, which is also a part of the tension-and-velocity controller 320*b*. Next, a velocity setting command is fed to the PID 324*b*, which subsequently sends out a velocity command signal to the tension and velocity control 326*b*. After receiving the tension output signal and the velocity output signal, the tension and velocity control 326b sends out a tension and velocity signal to the take-up roll 212*b*.

Depending on the tension and velocity signals received by the feed roll 212*a* and take-up roll 212*b*, the feed roll 212*a* and take-up roll 212*b* may, if necessary, each rotate inwardly in the direction (TA) so as to adjust the tension exerted on the polishing pad strip 202 to a desired level. Once the tension applied to the polishing pad strip 202 is set to a desired level, the feed roll 212*a* and take-up roll 212*b* start, preferably, a synchronous reciprocation thereby causing the polishing pad to oscillate at a linear velocity under the polishing head 204. Thus, in this embodiment, similar to some of the embodiments, the feed roll 212*a* and take-up roll 212*b* can change, if necessary, the velocity of the polishing pad 202 so as to maintain a desired velocity for optimum polishing performance.

Although the foregoing invention has been described in some detail for purposes of clarity of understanding, it will be apparent that certain changes and modifications may be practiced within the scope of the appended claims. For example, embodiments described herein have been primarily directed toward wafer polishing, however, it should be understood that the polishing operations are well suited for precision polishing of any type of substrate. Accordingly, the present embodiments are to be considered as illustrative and not restrictive, and the invention is not to be limited to the details given herein, but may be modified within the scope and equivalents of the appended claims.

What is claimed is:

1. A chemical mechanical polishing (CMP) apparatus, comprising:

a polishing pad strip defined between a first point and a second point, the first point being separate from the second point;

a feed roll having a supply of the polishing pad strip, the feed roll defining the first point; and a take-up roll configured to collect at least a linear portion of the polishing pad strip, the take-up roll defining the second point, wherein the feed roll and the take-up roll are configured to reciprocate so that the polishing pad strip oscillates at least partially between the first point and the second point.

2. A chemical mechanical polishing (CMP) apparatus as recited in claim 1, wherein the polishing pad strip oscillates at a programmable rate at least partially between the first point and the second point.

3. A chemical mechanical polishing (CMP) apparatus as recited in claim 2, wherein the programmable rate defines a linear velocity for the polishing pad strip in a direction between the first point and the second point as well as between the second point and the first point.

4. A chemical mechanical polishing (CMP) apparatus as recited in claim 1, wherein the first tension actuator is configured to controllably pull on the feed roll so as to apply tension to the polishing pad strip, and wherein the second tension actuator is configured to controllably pull on the take-up roll so as to apply tension to the polishing pad strip.

5. A chemical mechanical polishing (CMP) apparatus as recited in claim 1, further comprising:

a first load cell roller;

a second load cell roller, the first load cell roller being defined at a first intermediate point and the second load cell roller being defined at a second intermediate point, the first intermediate point and the second intermediate point being located under and supporting the polishing pad strip and between the first point and the second point.

6. A chemical mechanical polishing (CMP) apparatus as recited in claim 5, further comprising:

a platen defined under the polishing pad strip in a location defined between the first intermediate point and the second intermediate point, the platen is configured to provide support for receiving a polishing head that is to be applied to the polishing pad strip, the polishing head is designed to hold a semiconductor wafer to be polished.

7. A chemical mechanical polishing (CMP) apparatus as recited in claim 5, further comprising:

a first idler roller positioned between the first point and the first intermediate point, the first idler roller configured to maintain a constant positional velocity for the polishing pad strip at a tangential interface with the first intermediate point defined by the first load cell roller; and a second idler roller positioned between the second point and the second intermediate point, the second idler roller configured to maintain a constant positional velocity for the polishing pad at a tangential interface with the second intermediate point defined by the second load cell roller.

8. A chemical mechanical polishing (CMP) apparatus as recited in claim 5, further comprising:

a first tension-velocity controller;

a second tension-velocity controller, each of the first and second tension-velocity controller being configured to receive a tension feedback signal, a tension setting command, a velocity feedback signal, and a velocity setting command, and each of the first and second tension-velocity controller being configured to output a velocity setting signal and a tension setting signal.

9. A chemical mechanical polishing (CMP) apparatus as recited in claim 8, wherein each of the first and second tension-velocity controller includes a tension control for setting each of the first tension actuator and the second tension actuator, respectively.

10. A chemical mechanical polishing (CMP) apparatus as recited in claim 3, further comprising:

a first tension-and-velocity controller;

a second tension-and-velocity controller, each of the first and second tension-and-velocity controller being configured to receive a tension feedback signal, a tension setting command, a velocity feedback signal, and a velocity setting command, and each of the first and second tension-and-velocity controller being configured to output a tension-and-velocity setting signal.

11. A chemical mechanical polishing (CMP) apparatus as recited in claim 10, wherein each of the first and second tension-and-velocity controller includes a tension and velocity control for setting each of the feed roll and the take-up roll, respectively.

12. A chemical mechanical polishing (CMP) apparatus as recited in claim 1, wherein the polishing pad strip is made from a fixed abrasive material.

13. A chemical mechanical polishing (CMP) apparatus as recited in claim 1, wherein the polishing pad strip, the feed roll and the take-up roll define a web handling arrangement.

14. A chemical mechanical polishing (CMP) apparatus as recited in claim 1, further comprising:

a first load cell roller;

a second load cell roller, the first load cell roller being defined at a first intermediate point and the second load cell roller being defined at a second intermediate point, the first intermediate point and the second intermediate point being located under and supporting the polishing pad strip and between the first point and the second point;

a first idler roller positioned between the first point and the first intermediate point; and a second idler roller positioned between the second point and the second intermediate point.

15. A chemical mechanical polishing (CMP) apparatus, comprising:

a first roller situated at a first point and a second roller situated at a second point, the first point being separate from the second point; and a polishing pad strip having a first end secured to the first roller and a second end secured to the second roller, wherein the first roller and the second roller are configured to reciprocate so that the polishing pad strip oscillates at least partially between the first point and the second point.

16. A chemical mechanical polishing (CMP) apparatus as recited in claim 15, further comprising:

a first idler roller; and a second idler roller, the first and second idler rollers being positioned between the first roller and the second roller.

17. A chemical mechanical polishing (CMP) apparatus as recited in claim 16, further comprising:

a first tension actuator connected to the first idler roller and a second tension actuator connected to the second idler roller, the first and second tension actuators being configured to apply a controlled tension to the polishing pad strip.

18. A chemical mechanical polishing (CMP) apparatus, comprising:

a polishing pad strip defined between a first point and a second point, the first point being separate from the second point;

a feed roll having a supply of the polishing pad strip, the feed roll defining the first point;

a take-up roll configured to collect at least a linear portion of the polishing pad strip, the take-up roll defining the second point;

a first tension actuator connected to the feed roll, the first tension actuator configured to controllably pull on the feed roll so as to apply tension to the polishing pad strip;

a second tension actuator connected to the take-up roll, the second tension actuator configured to controllably pull on the take-up roll so as to apply tension to the polishing pad strip;

a first load cell roller;

a second load cell roller, the first load cell roller being defined at a first intermediate point and the second load cell roller being defined at a second intermediate point, the first intermediate point and the second intermediate point being located under and supporting the polishing pad strip and between the first point and the second point; and a platen defined under the polishing pad strip in a location defined between the first intermediate point and the second intermediate point, the platen being configured to provide support for receiving a polishing head that is to be applied to the polishing pad strip, the polishing head being designed to hold a semiconductor wafer to be polished, wherein the feed roll and the take-up roll are configured to reciprocate so that the polishing pad strip oscillates at least partially between the first point and the second point.

19. A chemical mechanical polishing (CMP) apparatus, comprising:

a polishing pad strip defined between a first point and a second point, the first point being separate from the second point;

a feed roll having a supply of the polishing pad strip, the feed roll defining the first point;

a take-up roll configured to collect at least a linear portion of the polishing pad strip, the take-up roll defining the second point;

a first tension actuator connected to the feed roll, the first tension actuator configured to controllably pull on the feed roll so as to apply tension to the polishing pad strip; and a second tension actuator connected to the take-up roll, the second tension actuator configured to controllably pull on the take-up roll so as to apply tension to the polishing pad strip;

a first load cell roller;

a second load cell roller, the first load cell roller being defined at a first intermediate point and the second load cell roller being defined at a second intermediate point, the first intermediate point and the second intermediate point being located under and supporting the polishing pad strip and between the first point and the second point;

a first idler roller positioned between the first point and the first intermediate point, the first idler roller configured to maintain a constant positional velocity for the polishing pad strip at a tangential interface with the first intermediate point defined by the first load cell roller; and a second idler roller positioned between the second point and the second intermediate point, the second idler roller configured to maintain a constant positional velocity for the polishing pad at a tangential interface with the second intermediate point defined by the second load cell roller, wherein the feed roll and the take-up roll are configured to reciprocate so that the polishing pad strip oscillates at least partially between the first point and the second point.

20. A chemical mechanical polishing (CMP) apparatus, comprising:

a polishing pad strip defined between a first point and a second point, the first point being separate from the second point;

a feed roll having a supply of the polishing pad strip, the feed roll defining the first point;

a take-up roll configured to collect at least a linear portion of the polishing pad strip, the take-up roll defining the second point;

a first tension actuator connected to the feed roll, the first tension actuator configured to controllably pull on the feed roll so as to apply tension to the polishing pad strip;

a second tension actuator connected to the take-up roll, the second tension actuator configured to controllably pull on the take-up roll so as to apply tension to the polishing pad strip;

a first load cell roller;

a second load cell roller, the first load cell roller being defined at a first intermediate point and the second load cell roller being defined at a second intermediate point, the first intermediate point and the second intermediate point being located under and supporting the polishing pad strip and between the first point and the second point;

a platen defined under the polishing pad strip in a location defined between the first intermediate point and the second intermediate point, the platen being configured to provide support for receiving a polishing head that is to be applied to the polishing pad strip, the polishing head being designed to hold a semiconductor wafer to be polished;

a first tension-velocity controller configured to include a tension control for setting the first tension actuator; and a second tension-velocity controller configured to include a tension control for setting the second tension actuator, each of the first and second tension-velocity controller being configured to receive a tension feedback signal, a tension setting command, a velocity feedback signal, and a velocity setting command, and each of the first and second tension-velocity controller being configured to output a velocity setting signal and a tension setting signal, wherein the feed roll and the take-up roll are configured to reciprocate so that the polishing pad strip oscillates at least partially between the first point and the second point.

21. A chemical mechanical polishing (CMP) apparatus, comprising:

a polishing pad strip defined between a first point and a second point, the first point being separate from the second point;

a feed roll having a supply of the polishing pad strip, the feed roll defining the first point;

a take-up roll configured to collect at least a linear portion of the polishing pad strip, the take-up roll defining the second point;

a first load cell roller;

a second load cell roller, the first load cell roller being defined at a first intermediate point and the second load cell roller being defined at a second intermediate point, the first intermediate point and the second intermediate point being located under and supporting the polishing pad strip and between the first point and the second point;

a first idler roller positioned between the first point and the first intermediate point; and a second idler roller positioned between the second point and the second intermediate point, wherein the feed roll and the take-up roll are configured to reciprocate so that the polishing pad strip oscillates at least partially between the first point and the second point.

22. A chemical mechanical polishing (CMP) apparatus, comprising:

a polishing pad strip defined between a first point and a second point, the first point being separate from the second point;

a feed roll having a supply of the polishing pad strip, the feed roll defining the first point, the feed roll configured to feed the polishing pad strip implementing a first motor; and a take-up roll configured to collect at least a linear portion of the polishing pad strip implementing a second motor, the take-up roll defining the second point, a first tension actuator connected to the feed roll; and a second tension actuator connected to the take-up roll, the first and second tension actuators being configured to apply a controlled tension to the polishing pad strip, wherein the first motor and the second motor respectively cause the feed roll and the take-up roll to reciprocate so that the polishing pad strip oscillates at least partially between the first point and the second point.

* * * * *

UNITED STATES PATENT AND TRADEMARK OFFICE

CERTIFICATE OF CORRECTION

PATENT NO. : 6,520,833 B1
DATED : February 18, 2003
INVENTOR(S) : Saldana et al.

It is certified that error appears in the above-identified patent and that said Letters Patent is hereby corrected as shown below:

Column 9,
Line 55, replace "feed roll defining the first point; and" with -- feed roll defining the first point; --.
Line 58, replace "second point," with -- second point; --.
Between lines 58 and 59, add:
-- a first tension actuator connected to the feed roll; and
a second tension actuator connected to the take-up roll, the first tension actuator and the second tension actuator configured to apply a controlled tension to the polishing pad strip, --.

Column 11,
Line 35, replace "roller and a second end secured to the second roller," with -- roller and a second end secured to the second roller; --.
Between lines 35 and 36, add:
-- a first tension actuator connected to the first roller; and
a second tension actuator connected to the second roller, the first and second tension actuators being configured to apply a controlled tension to the polishing pad strip, --.

Signed and Sealed this

Tenth Day of January, 2006

JON W. DUDAS
*Director of the United States Patent and Trademark Office*